United States Patent [19]

Yarwood et al.

[11] 4,446,909

[45] May 8, 1984

[54] PROCESS AND APPARATUS FOR ELECTROMAGNETIC CASTING OF MULTIPLE STRANDS HAVING INDIVIDUAL HEAD CONTROL

[75] Inventors: John C. Yarwood, Madison; Gary L. Ungarean, Woodbridge; Peter J. Kindlmann, Guilford; Derek E. Tyler, Cheshire, all of Conn.

[73] Assignee: Olin Corporation, New Haven, Conn.

[21] Appl. No.: 501,941

[22] Filed: Jun. 7, 1983

Related U.S. Application Data

[63] Continuation of Ser. No. 236,386, Feb. 20, 1981, abandoned.

[51] Int. Cl.[3] ..... B22D 11/01; B22D 27/02

[52] U.S. Cl. ..... 164/453; 164/467; 164/503

[58] Field of Search ..... 164/467, 503, 147.1, 164/498, 452, 453; 373/139

[56] References Cited

U.S. PATENT DOCUMENTS

| | | | |
|---|---|---|---|
| 3,467,166 | 9/1969 | Getselev et al. | 164/467 |
| 3,605,865 | 9/1971 | Getselev | 164/503 |
| 3,702,155 | 11/1972 | Getselev | 164/503 |
| 3,935,059 | 1/1976 | Ayel | 373/139 X |
| 4,014,379 | 3/1977 | Getselev | 164/467 X |
| 4,161,206 | 7/1979 | Yarwood et al. | 164/467 |
| 4,215,738 | 8/1980 | Gaule et al. | 164/467 |

FOREIGN PATENT DOCUMENTS

| | | |
|---|---|---|
| 32442 | 7/1981 | European Pat. Off. . |
| 3016044 | 12/1980 | Fed. Rep. of Germany . |
| 2041803 | 9/1980 | United Kingdom . |

*Primary Examiner*—Kuang Y. Lin

*Attorney, Agent, or Firm*—Howard M. Cohn; Paul Weinstein; Barry L. Kelmachter

[57] ABSTRACT

A multi-strand apparatus and process for casting molten material into ingots of desired shape. A plurality of structures are provided for receiving and electromagnetically forming the molten material into the desired shape. Each receiving and forming structure includes an inductor for applying a magnetic force field to the molten material. When the inductor is in operation, it is spaced from the molten material by a gap extending from the surface of the molten material to the opposing surface of the inductor. Structure is provided for distributing a current in the inductor to generate the magnetic field. The improvement comprises a device arranged below the inductor for modifying the current distribution in the inductor to minimize the variations in the gap.

8 Claims, 3 Drawing Figures

PROCESS AND APPARATUS FOR ELECTROMAGNETIC CASTING OF MULTIPLE STRANDS HAVING INDIVIDUAL HEAD CONTROL

This application is a continuation, of application Ser. No. 236,386, filed Feb. 20, 1981, now abandoned.

While the invention is subject to a wide range of applications, it is especially suited for use in the electromagnetic forming of a plurality of castings and will be particularly described in that connection. The process and apparatus provide for the individual head control of the molten casting using a single power source.

The electromagnetic casting apparatus comprises a three-part mold consisting of an inductor, a non-magnetic screen and a manifold for applying cooling water to the ingot. Such an apparatus is exemplified in U.S. Pat. No. 3,467,166 to Getselev et al. Containment of molten material, such as metal, in electromagnetic casting is achieved without direct contact between the molten metal and any component of the mold. The molten metal head is contained by a magnetic force. The magnetic force results from the passage of an alternating current through an inductor surrounding the molten metal head. Accordingly, control of the containment process involves control of the molten metal head and/or control of the alternating current amplitude. Without such control, ingots or castings of variable cross sections and surface quality result as successive equilibria between the magnetic force and the molten metal head are established. Note that the solidification of the molten metal is achieved by direct application of water from the cooling manifold to the ingot shell.

Control of the metal head may be achieved by a variety of techniques known in the art. U.S. patent application No. 110,893, by Ungarean et al. entitled "Electromagnetic Casting Process and Apparatus" (now abandoned) discloses, for example, that "the magnetic field defines a containment zone for the molten metal. The hydrostatic pressure exerted by the molten metal in the containment zone is sensed and in response thereto the flow of molten metal into the containment zone is controlled. This minimizes changes in the hydrostatic pressure."

Techniques for control of inductor current are also known in the art. U.S. Pat. No. 4,014,379 to Getselev discloses, for example, an electromagnetic casting system wherein "the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down." Also, in U.S. Pat. No. 4,161,206 to Yarwood et al., an electromagnetic casting apparatus and process is provided wherein, for example, "a control system is utilized to minimize variations in the gap between the molten metal and an inductor which applies the magnetic field. The gap or an electrical parameter related thereto is sensed and used to control the current to the inductor."

Another technique of controlling the molten head is disclosed in U.S. Pat. No. 4,285,387 to Kindlmann et al. where there is provided, for example, "an actively driven shield in an electromagnetic casting apparatus for use at typical electromagnetic casting frequencies which will attenuate the magnetic field generated by the primary inductor . . . " However, the shield is located above the casting apparatus.

Control of the electromagnetic process by regulation of liquid metal head at constant inductor current or voltage requires very tight control of the head, i.e. ±0.1 mm. Such control is feasible in low speed casting of large aluminum ingots, but is very difficult to achieve for heavier, higher melting point metals, i.e. copper or iron, especially at moderate or high casting speeds with relatively small cross sections. Accordingly, in electromagnetic casting of copper alloys, control of inductor current is the preferred technique of regulating the height of the molten head. In this latter case, the head level must be controlled but larger variation, i.e. ±10 mm, can be tolerated.

The above description refers to casting of one ingot (or strand) at a time. Where multi-strand casting is undertaken, control of every strand must be maintained. The most obvious technique for achieving this goal is to use either head or current control with each inductor powered by a separate inverter. However, this arrangement may have certain undesirable characteristics. For example, beat frequencies established by the interaction of the several inverters may cause containment control problems due to the pumping or agitation effects of the low frequency alternating current interacting with the molten head. Also, more space is required for installation of the additional inverters as well as additional maintenance and capital costs.

Thus, the use of a single power supply for a plurality of electromagnetic casting stations is preferable. However, control problems are also encountered with this type of arrangement. For example, if the inductors are connected in series to a single power supply, then the same current amplitude is established in each inductor independent of the conditions in the particular electromagnetic casting station. The current, however, depends on the supply voltage and the average conditions extant in the strands which control their total reactance. Since the conditions in the various molds may differ at any particular time, the metal head may have a different cross section in each of the molds whereby the plurality of cast ingots are not uniform. An example of a plurality of inductors connected in series is disclosed in U.S. Pat. No. 3,702,155 to Getselev.

Another solution may be to connect the plurality of casting stations in parallel whereby the voltage applied to each inductor is independent of the exact conditions in the particular electromagnetic casting device. Then, the individual inductor current changes in response to changes in the reactance of the particular inductor. However, independent control over the voltage of the individual inductors as required by the prior art system as disclosed in U.S. Pat. Nos. 4,161,206 and 4,014,379 is not possible.

In conclusion, by maintaining the molten head nearly constant in each of the casting molds, either voltage or inductance control can be used in conjunction with a simple fixed voltage supply. However, as noted above and detailed in U.S. Pat. Nos. 4,014,379 and 4,161,206, such control of head is not readily attainable, especially for heavier, high melting metals cast in smaller sections at moderate to high speed.

It is a problem underlying the present invention to provide independent containment control of each strand of a multi-strand electromagnetic casting system.

It is an advantage of the present invention to provide a multi-strand apparatus for casting molten materials with a plurality of ingots of desired shape which obviates one or more of the limitations and disadvantages of the described prior arrangements.

It is a further advantage of the present invention to provide a multi-strand apparatus for casting molten materials into a plurality of ingots wherein shape pertubations in the surfaces of the plurality of resultant castings are minimized.

It is a still further advantage of the present invention to provide a multi-strand apparatus and process for casting molten materials into a plurality of ingots of desired shape wherein the gap between the molten material and the plurality of inductors is sensed electrically and the current distribution within the individual inductors is controlled in response thereto.

It is a yet further advantage of the present invention to provide a multi-strand apparatus and process for casting molten materials into a plurality of ingots requiring not only less, but smaller, equipment and, therefore, providing more economical construction and maintenance.

Accordingly, there has been provided a multi-strand apparatus and process for casting molten material into two ingots of desired shape. Structure is provided for receiving and electromagnetically forming the molten materials into the desired shapes. Each of the receiving and forming structures include an inductor for applying a magnetic force field to the molten material. When the inductor is in operation, it is spaced from the molten material by a gap extending from the surface of the molten material to the opposing surface of the inductor. Structure is provided for distributing a current in the inductor to generate the magnetic field. The improvement comprises a device arranged below the inductor for modifying the current distribution in the inductor to minimize the variations in the gap.

The invention and further developments of the invention are now elucidated by means of preferred embodiments shown in the drawings.

Figure 1:
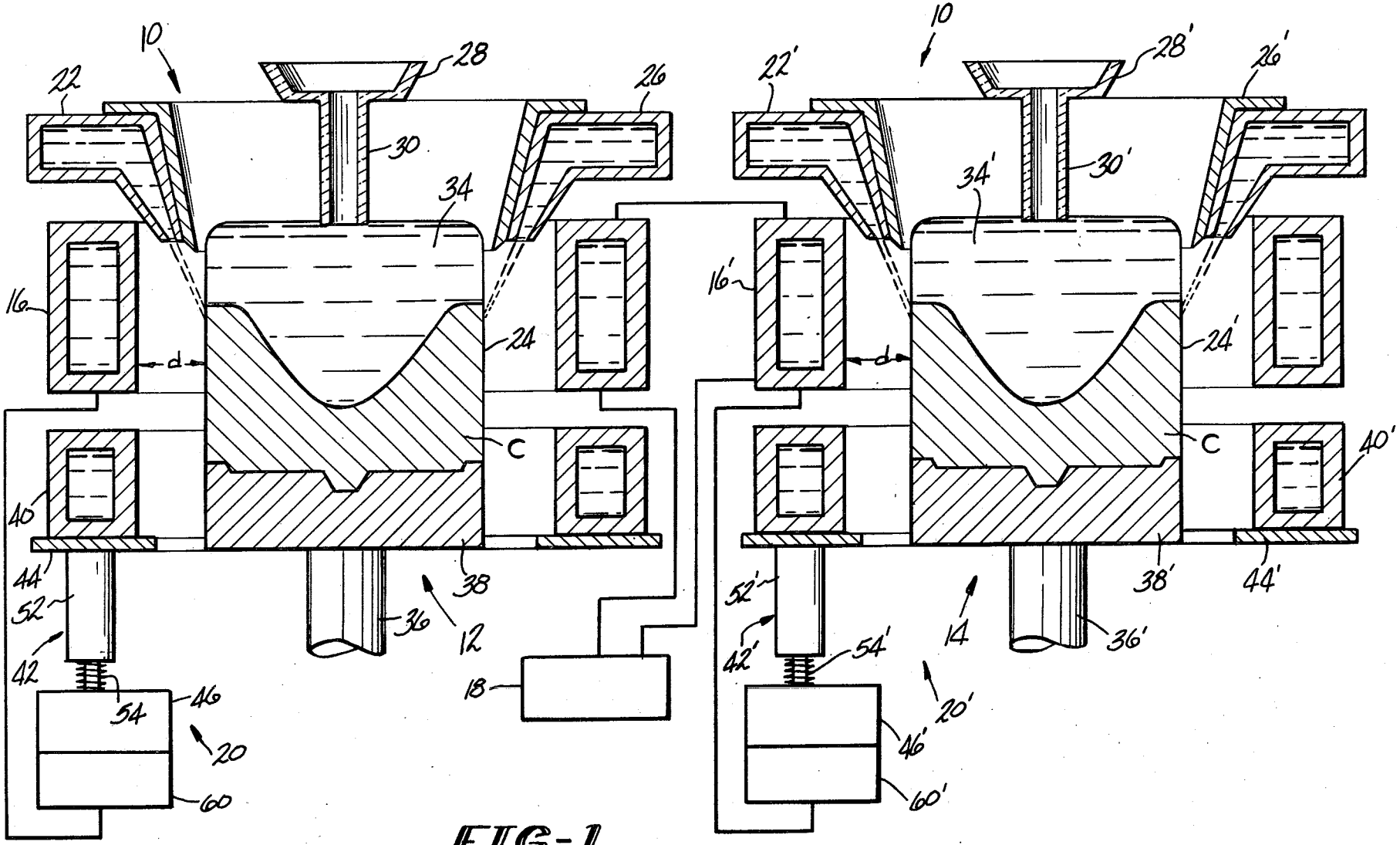
FIG. 1 is a schematic representation of an electromagnetic casting apparatus in accordance with the present invention.

The present invention provides a multi-strand apparatus 10 for casting molten materials into two ingots of desired shape. Two devices 12 and 14 receive and electromagnetically form the molten material into the desired shape. Each of the receiving and forming devices includes an inductor 16, 16' for applying a magnetic force to the molten material. The inductor in operation is spaced from the molten material by a gap "d" extending from the surface of the molten material to the opposing surface of the inductor. A device 18, such as a power source, distributes a single current in each of the inductors to generate the magnetic field. Structure 20, 20' is arranged below each of the inductors 16, 16', respectively, for modifying the current distribution in the associated inductor to minimize the variations in the gap "d" of the particular receiving and forming apparatus.

Referring now to FIG. 1, there is shown by way of example an electromagnetic casting apparatus of this invention including two casting strands. Since the elements of each casting device may be substantially identical, prime numbers are used to indicate like elements. Further, only one of the molds is described in general since they both operate in the same manner.

The electromagnetic casting mold 12 is comprised of inductor 16 which is water cooled; a cooling manifold 22 applies cooling water to the peripheral surface 24 of the molten material such as metal being cast C; and a nonmagnetic screen 26. Molten metal is continuously introduced into the molds 12, 14 during a casting run using a trough 28 and downspout 30 and molten metal gap control in accordance with this invention. The inductor 16 is excited by an alternating current from a power source 18.

The alternating current in the inductor 16 produces a magnetic field which interacts with the molten metal head 34 to produce eddy currents therein. These eddy currents in turn interact with the magnetic field and produce forces which apply a magnetic pressure to the molten metal head to contain it in the zones defined by the magnetic field so that it solidifies into an ingot C having a desired cross section.

An air gap "d" exists during casting, between the molten metal head 34 and the inductor 16. The molten metal head is formed or molded into the same general shape as the corresponding inductor thereby providing the desired ingot cross section. The inductor may have any desired geometrical shape including circular or rectangular as required to obtain the desired cross section of ingot C.

The purpose of the non-magnetic screen 26 is to fine tune and balance the magnetic pressure with the hydrostatic pressure of the molten metal head. The non-magnetic screen may comprise a separate element as shown or may, if desired, be incorporated as a unitary part of the manifold for applying the coolant.

Initially, a conventional ram 36 and bottom block 38 are held in the magnetic containment zone of the mold to allow the molten metal to be poured into the mold at the start of the casting run. The ram and bottom block are then uniformly withdrawn at a desired casting rate.

Solidification of the molten metal, which is magnetically contained in the mold, is achieved by direct application of water from the cooling manifold 22 to the ingot surface 24. In the embodiment, which is shown in FIG. 1, the water is applied to the ingot surface 24 within the confines of the inductor 16. The water may be applied to the ingot surface above, within or below the related inductor as desired.

If desired, any of the prior art mold constructions or other known arrangements of the electromagnetic casting apparatus as described in the background of the invention could be employed for either one or all of the plurality of casting apparatuses used in accordance with the invention.

The present invention is concerned with the control of a multi-strand electromagnetic casting process and apparatus in order to provide cast ingots C which have a substantially uniform cross section over the length of the ingot and which are formed of materials such as metals, alloys, metalloids, semi-conductors, etc. This is accomplished in accordance with the present invention by sensing the electrical properties of the individual inductors which are a function of the gap "d" between the inductor and the load. The load consists of the molten material head corresponding to the pool of molten metal arranged above the solidifying ingot C which exerts the aforenoted hydrostatic pressure in the magnetic containment zone. In a vertical casting apparatus as shown in FIG. 1, the molten metal head 34 extends from the top surface of the molten metal pool to the solid-liquid interface or solidification front and further includes a limited contribution associated with the molten material in and above the downspout 30. The electrical property of the casting apparatus, which is a function of the gap between the molten metal head 34 and the interior surface of the inductor 16, is sensed and a gap signal representative thereof is generated. Responsive to the gap signal, the current distribution is modified in the inductor so as to maintain the gap substantially constant.

A device 20 is arranged below the inductor 16 for modifying the current distribution in the inductor to minimize the variations in the gap. The device 20 includes a loop 40 adjustable along the casting axis for redistributing the current in an associated inductor 16 closer to the loop as the loop is moved closer to the inductor. The loop surrounds the ingot C and may be externally or internally cooled in a known manner such as a coolant flowing in a hollow interior of the loop. The loop, also referred herein as ring, is preferably formed in substantially the geometrical shape as the associated inductor 16. The loop is constructed of a non-magnetic, highly conductive material, such as for example pure copper, and has a preferable wall thickness of at least two penetration depths at the operating frequency of the associated inductor. The device 20 includes adjustment structure 42 for positioning the loop device in response to changes in the electrical parameter of the inductor, as will be further described hereinbelow. The adjustment apparatus includes a support plate 44 which may be affixed to the bottom surface of the ring 40 by any conventional means such as for example welding. Movement of the ring 40 up or down in accordance with this invention is fully automated by means of a suitable actuator 46 which can be controlled electrically.

Figure 2:
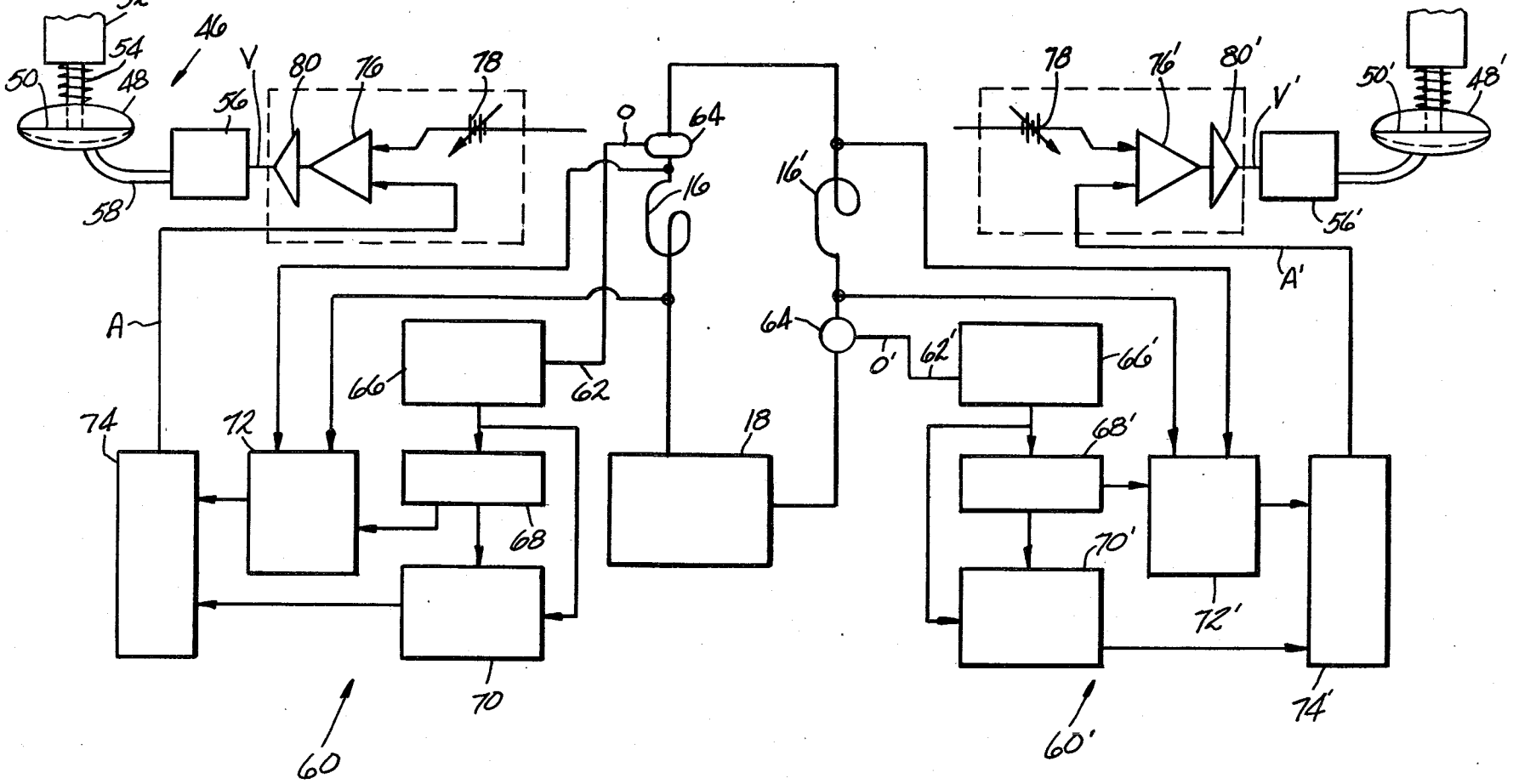
FIG. 2 is a box diagram of an electrical control circuit for the present invention.

The actuator 46, shown in FIGS. 1 and 2, may comprise a pneumatic actuator. The pneumatic actuator includes a housing 48 internally of which is supported a flexible diaphragm 50. The diaphragm 50 in turn is connected to a rod 52. The rod 52 is normally biased to its closed position by means of a spring 54 extending between the rod and the respective housing of the pneumatic actuator 46. Air is introduced or withdrawn from the housing 48 by a voltage-to-pressure transducer 56. The magnitude of the air pressure applied by the transducer 56 to the housing via conduit 88 is directly proportional to the magnitude of a control voltage signal V output to the transducer 56. Variations in the signal V cause corresponding variation in the output pressure of the transducer 56. A suitable transducer 56 comprises a Model T5100 series manufactured by Fairchild, Inc. of North Carolina.

The air pressure from the transducer 56 deflects the diaphragm 50 as shown in phantom in proportion to the magnitude of the air pressure. This causes the rod 52 to be raised from its fully lowered position. The position of the rod is, therefore, a function of the pressure on the lower side of the diaphragm 50. As the pressure increases, the deflection of the diaphragm 50 increases and, therefore, the ring 40 moves closer to the inductor 16 to modify the current distribution in the inductor as will be further described. Similarly, as the pressure decreases, the ring moves further away from the inductor and diminishes the effect of the ring 40 on the inductor 16.

Referring to FIG. 2, there is shown inductors 16, 16' which are connected in series and powered by a power source 18. In addition, control systems 60, 60' sense an electrical parameter of each inductor through sensing lines 62, 62'. The power source 18 preferably delivers alternating current of substantially constant and controlled amplitude. As above, only one of the control systems is described since the other may be substantially identical.

The control system 60 may be of any desired design including any of these described in the background of this application. However, preferably it is a system in accordance with the U.S. Pat. No. 4,161,206 to Yarwood et al. patent. In that system, a reactive parameter O of the inductor is sensed which is a function of the gap "d" between the molten material head 34 and the inductor 16. The sensed parameter O is compared with a preset value thereof and an error signal A is generated which is a function of the difference between the magnitude of the sensed parameter and a preset value thereof. As the sensed parameter O changes, so does the error signal A in correspondence thereto. If the sensed parameter corresponds to inductance, as in the preferred approach of the Yarwood et al. patent, then the control system is adapted to control the position of the loop in a way so as to maintain a substantially constant inductance and thereby a substantially uniform ingot cross section.

The changes in the value of the error signal are a function of changes in the hydrostatic pressure of the molten metal head 34. As the molten metal head increases in height either due to an increase in the height of the upper surface or to a lowering of the solidification front or both, there is an increase in hydrostatic pressure. This hydrostatic pressure increase would normally increase the cross section of the resultant ingot C. However, the control system is effective to counteract this increase in hydrostatic pressure by modifying the current distribution in the inductor to drive the error signal towards zero. These changes occur very rapidly, in fractions of a second, so that the inductance and cross section of the ingot appear substantially constant throughout.

Referring again to FIG. 2, the control circuit 60 illustrated therein is principally applicable to an arrangement wherein the frequency of the power supply 18 during operation is maintained fixed at some preselected frequency. Therefore, with this control circuit 60, it is only necessary to measure a change in the reactance of the inductor 16 and load 34 to obtain a signal indicative of a change in gap "d".

A current transformer 64 senses the current in inductor 16. A current-to-voltage scaling resistor network 66 generates a corresponding voltage. This voltage is fed to a phase-locked loop circuit 68 which "locks" onto the fundamental of the current waveform and generates two sinusoidal phase reference outputs, with phase angles of 0° and 90° with respect to the current fundamental. Using the 0° phase reference, phase-sensitive rectifier 70 derives the fundamental frequency current amplitude. The 90° phase reference is applied to phase-sensitive rectifier 72 which derives the fundamental voltage amplitude due to inductive reactance. The voltage signals from 70 and 72, which are properly scaled, are then fed to an analog voltage divider 74 wherein the voltage from rectifier 70 is divided by the voltage from rectifier 72 to obtain an output signal which is proportional to the reactance of the inductor 16 and load 34.

The output signal A of the divider 74 is applied to the inverting input of a differential amplifier 76 operating in a linear mode. The non-inverting input of the amplifier 76 is connected to an adjustable voltage source 78. The output of amplifier 76 is fed to an error signal amplifier 80 to provide a voltage error signal V which is applied to the actuator 46 in order to provide a feedback control thereof. Amplifier 80 preferably also contains frequency compensation circuits for adjusting the dynamic behavior of the overall feedback loop.

The error signal from the amplifier 80 is proportional to the variation in the reactance of the inductor 16 and load 34 and also corresponds in sense or polarity to the direction of the variation in the reactance. The adjustable voltage source provides a means for adjusting the gap "d" to a desired set point. The feedback control system 60 provides a means for driving the variation in the gap "d" to a minimum value or zero. The control system 60 described by reference to FIG. 2 is principally applicable in a mode of operation wherein the frequency once set is held constant though it is not necessarily limited to that mode of operation, particularly for small changes in frequency.

In operation, the multi-strand apparatus 10 of the present invention senses a change in the hydrostatic pressure of the molten metal head 34. If the magnitude of the hydrostatic pressure change signal O increases or decreases with time, depending on whether the hydrostatic pressure is increasing or decreasing, then the amplifier 80 provides an appropriate control signal V for controlling the actuator 46 of the ring 40. The ring 40 is mounted so that its position is adjustable along the strand axis. Accordingly, it can be moved in such a manner as to approach or retreat from the inductor. The proximity of the ring to the inductor influences the current distribution in the inductor in such a way as to modify the distribution of the induced current in the casting strand and hence the containment force. With the ring far below the inductor, i.e. several inches, the ring has little or no effect on the inductor current distribution. As the ring is raised into close proximity to the inductor, i.e. less than one inch, the current is induced in it and current in the inductor is redistributed so that more current flows in the lower part of the inductor and less in the upper section. Since it is the current in the upper section of the inductor which predominates in inducing current in the contained molten material, the containment force applied to the molten material is reduced by this redistribution of current. At the same time, changes in the hydrostatic pressure of molten head 34' can be independently balanced by changing the containment force generated by inductor 16'. Thus, the present invention provides automatic control of the individual strands by adjustment of the position of the individual rings in response to measured changes in, for instance, inductance of an individual inductor as indicated in U.S. Pat. No. 4,161,206. It is important to note that the adjustment of the ring does not change the total current in the inductor but only its distribution.

Figure 3:
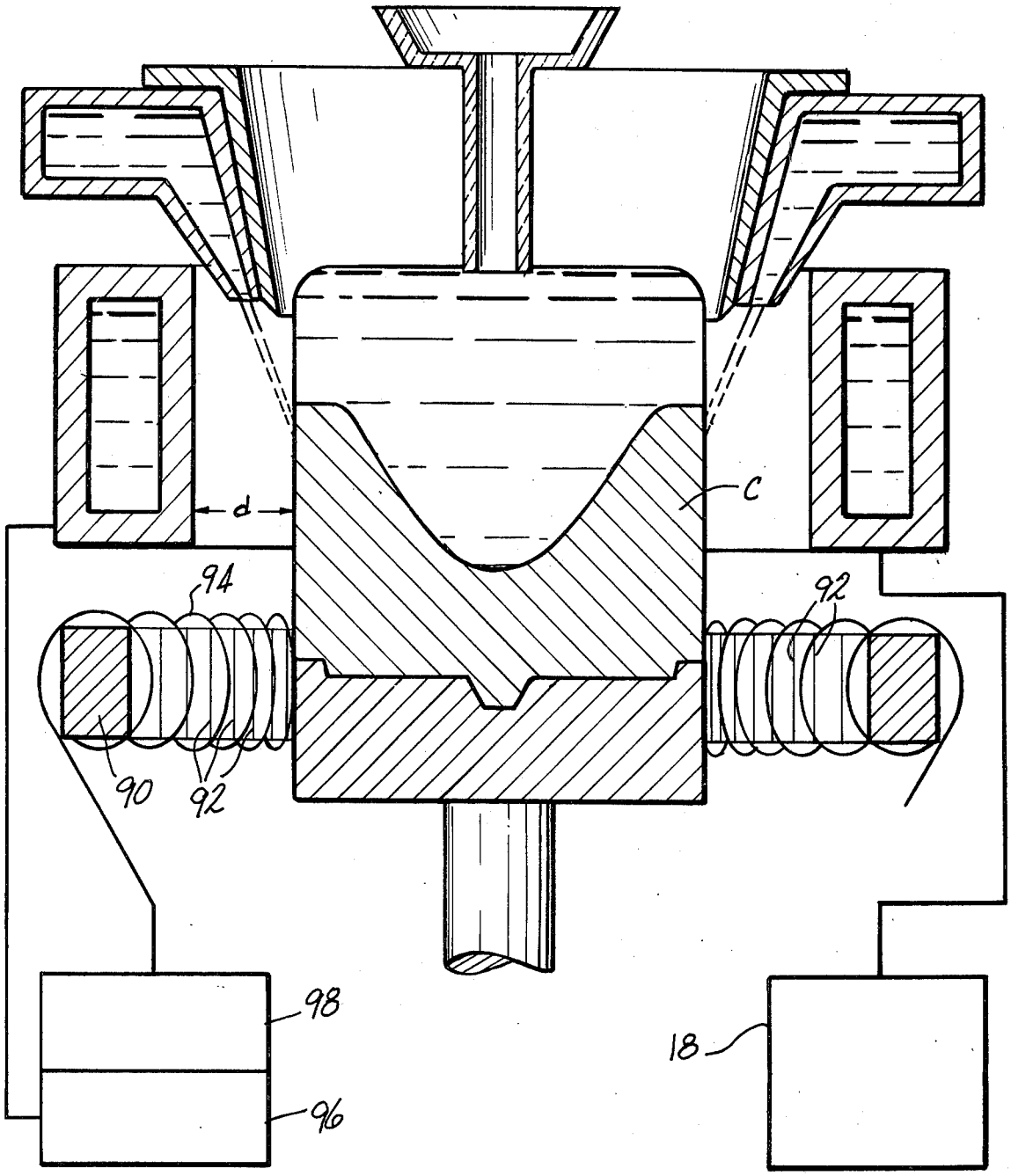
FIG. 3 is a schematic illustration of a second embodiment of the present invention.

An alternative device to modify current distribution in an inductor is illustrated in FIG. 3. This device provides independent containment control over each strand of a plurality of series connected electromagnetic casting devices. The containment control is provided by a variable saturable core 90. The core is preferably of a laminated construction from transformer grade iron. The laminations are parallel to the strand axis and the interfaces 92, which can be substances such as varnish, plastic, epoxy, etc., act to break the current flow through the core so as to avoid large eddy current losses. The geometric form of the core is preferably similar to that of the inductor, i.e. round for a round ingot, rectangular for a rectangular ingot, etc. The permeability of the core is governed by a substantially evenly-spaced toroidal control winding 94 which is preferably designed to allow saturation of the core at full rated current. At zero current in the winding, the core has its full available permeability and considerable flux linkage between the inductor and core exists as described below. The core 90 is located in surrounding relation to the ingot and strand and positioned immediately below the inductor.

A control system 96, which may be substantially identical to control system 60 described hereinabove, is responsive to the desired electrical parameters within its associated inductor. An error signal V generated by the control system is applied to a current control supply 98 which controls the current in the toroidal winding 94. The control current may be either AC or DC. Where alternating current is used, it must be in phase and synchronized with the inductor current to insure correct relationship between flux in the core and the inductor.

In operation, varying the current in the winding 94 alters the saturation of the core and alters the flux linkage between the inductor and the core. According to the available permeability of the core, magnetic fluxes created by the associated inductor bend down towards the core and are drawn through the core. As the magnetic fluxes bend down, the current in the inductor is redistributed closer to the core since the lower part of the inductor where the magnetic fluxes are bring drawn off provides a least energetic path for the current. As the current path moves towards the lower end of the inductor, the containment force applied to the molten material is reduced as in the first embodiment described hereinabove.

At zero current in the winding, the core has its full available permeability and considerable flux linkage between the inductor and core exists. At this stage, the containment force applied to the molten material is considerably reduced as compared to when no core is present. By increasing the current in the control winding, the permeability of the core is reduced and there is a lessening flux linkage between the inductor and core which causes an increased containment force applied to the molten material. When full current is applied and the core is magnetically saturated, the maximum containment force on the molten material of the ingot C is provided, and it is substantially equivalent to the absence of a core.

The control supply 98 may be adjusted by control system 96 similar to the pneumatic electric actuator of the first embodiment. For example, a voltage error signal V may be generated by an error signal amplifier 80 and applied to the control supply 98 in order to provide a feedback control thereof. The error signal is proportional to the variation in the reactance of the inductor and its load and also corresponds in sense or polarity to the direction of the variation in the reactance. The adjustable voltage source 78 provides a means for adjusting the gap "d" to a desired set point. The feedback control system 96 provides a means for driving the variation in the gap "d" to a minimum value or zero. Thus, this embodiment of the present invention provides automatic control of the individual strands by varying the current in the toroidal windings in response to measured changes in, for instance, inductance of an individual inductor as indicated in U.S. Pat. No. 4,161,206.

It should be understood that any desired number of inductors may be connected in series with each other and have their current distribution independently controlled. Any combination of apparatuses, such as the adjustable ring or saturable core, can be used together if desired.

It is apparent that there has been provided in accordance with this invention a multi-strand electromagnetic casting apparatus and method which fully satisfies the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In an apparatus for casting molten material into an ingot of desired shape comprising:

means for receiving and electromagnetically forming said molten material into said desired shape, said receiving and forming means including:

an inductor disposed about a longitudinal axis in the direction of casting for applying a magnetic containment force field to contain the molten material, said inductor in operation, being spaced from said molten material by a gap extending from the surface of the molten material to the opposing surface of the inductor, and means for supplying a current to the inductor to generate the magnetic containment field; the improvement comprising:

means for sensing an electrical parameter of said inductor which varies with the magnitude of the gap, means responsive to the sensing means for generating an error signal which is a function of the difference between the sensed value of said electrical parameter and a predetermined value thereof, means responsive to said error signal generating means for varying the magnetic containment force field applied to said molten material by redistributing the current in said inductor so as to drive said error signal towards zero, and said containment force field varying means comprising: a core of variable permeability having laminated construction to prevent current flow therethrough, said core further being arranged in surrounding relation to the casting axis and adjacent said inductor, control winding means about said core for varying the permeability of said core, and means for supplying a variable control current to said control winding means in response to said error signal so that an increase in the control current reduces the available permeability of the core and decreases the flux linkage with magnetic fluxes generated by said inductor resulting in a redistribution of the current in the inductor away from said core and a decrease in the control current increases the available permeability of the core and the flux linkage with magnetic fluxes generated by said inductor resulting in a redistribution of the current in said inductor closer to said core whereby variations in said gap are minimized.

2. The apparatus of claim 1 wherein said electrical parameter comprises the reactance of the inductor.

3. The apparatus of claim 1 wherein said electrical parameter comprises the inductance of the inductor.

4. In a multi-strand apparatus for casting molten material into at least two ingots of desired shape, comprising:

at least two means for receiving and electromagnetically forming said molten material into said at least two ingots, each of said receiving and forming means being electrically connected in series and including:

an inductor disposed about a longitudinal axis in the direction of casting for applying a magnetic containment force field to contain the molten material, said inductor in operation, being spaced from said molten material by a gap extending from the surface of the molten material to the opposing surface of the inductor, and means for supplying a series current through the at least two serially connected inductors to generate their respective magnetic containment fields; the improvement comprising:

means for sensing at least one electrical parameter for each of said inductors which varies with the magnitude of their respective gaps, means responsive to the sensing means for generating an error signal corresponding to each inductor, each error signal being a function of the difference between the sensed value of said electrical parameter for each of said inductors and a corresponding predetermined value thereof, means responsive to said error signal generating means for independently varying the magnetic containment force fields generated by each of said inductors and being applied to said molten material by redistributing the current in each of said inductors so as to selectively drive their respective error signals towards zero, and said containment force field varying means comprising: at least first and second cores each arranged in surrounding relation to a casting axis and adjacent a different one of said inductors, each of said cores being of variable permeability and having laminated construction to prevent current flow therethrough, control winding means about each of said cores for independently varying the permeability of said cores, and means for supplying variable control current to each of said control winding means in response to the error signal corresponding to their respective inductor so that an increase in the control current being supplied to either of said control winding means reduces the available permeability of that core and decreases the flux linkage with magnetic fluxes generated by the corresponding inductor resulting in a redistribution of the current in that inductor away from its corresponding core and a decrease in the control current to either of said control winding means increases the available permeability of the corresponding core and the flux linkage with magnetic fluxes generated by the corresponding inductor resulting in a redistribution of the current in that inductor closer to the corresponding core whereby variations in the gap of each inductor are minimized.

5. The apparatus of claim 4 wherein said at least one electrical parameter comprises the reactance of the inductors.

6. The apparatus of claim 4 wherein said at least one electrical parameter comprises the inductance of the inductors.

7. A process for casting molten material into an ingot of desired shape, comprising the following steps:

receiving and electromagnetically forming said molten material into said desired shape, said step of receiving and forming including the steps of:

providing an inductor disposed about a longitudinal axis in the direction of casting for applying a magnetic containment force field to contain the molten material, said inductor in operation, being spaced from said molten material by a gap extending from the surface of the molten material to the opposing surface of the inductor, and supplying a current to the inductor to generate the magnetic containment field; the improvement comprising the steps of:

sensing an electrical parameter of said inductor which varies with the magnitude of the gap, generating an error signal which is a function of the difference between the sensed value of said electrical parameter and a predetermined value thereof, varying the magnetic containment force field applied to said molten material by redistributing the current in said inductor so as to drive the error signal towards zero, said step of varying the magnetic containment force field, comprising the steps of:

providing a core of variable permeability having laminated construction to prevent current flow therethrough, positioning said core in surrounding relation to the casting axis and adjacent said inductor, providing a control winding about said core, supplying a variable control current to said control winding in response to said error signal so that an increase in the control current reduces the available permeability of said core and decreases the flux linkage with the magnetic fluxes generated by said inductor resulting in a redistribution of the current in the inductor away from said core and a decrease in the control current increases the available permeability of the core and the flux linkage with magnetic fluxes generated by said inductor resulting in a redistribution of the current in the inductor closer to said core whereby variations in said gap are minimized.

8. A process for casting molten material into at least two ingots of desired shape comprising the following steps:

receiving and electromagnetically forming molten material into at least two ingots, said step of receiving and forming including the steps of:

providing at least two inductors being electrically connected in series and disposed about a longitudinal axis in the direction of casting for applying separate magnetic containment force fields to the molten material corresponding to each ingot, each of said at least two inductors in operation being spaced from said molten material associated with its corresponding ingot by a gap extending from the surface of the molten material to the opposing surface of the corresponding inductor, supplying a series current through the at least two serially connected inductors to generate their respective magnetic containment fields; the improvement comprising the steps of:

sensing at least one electrical parameter for each of the inductors which varies with the magnitude of their respective gaps, generating an error signal corresponding to each inductor in response to the corresponding sensed electrical parameter, each error signal being a function of the difference between the sensed value of said electrical parameter for each of said inductors and a corresponding predetermined value thereof, independently varying the magnetic containment force fields generated by each of said inductors and being applied to said molten material by redistributing the current in each of said inductors so as to selectively drive their respective error signals towards zero, said step of varying the magnetic containment force field, comprising the steps of:

providing at least two cores of variable permeability having laminated construction to prevent current flow therethrough, positioning each of the at least two cores in surrounding relation to a different casting axis and adjacent a corresponding inductor, providing a control winding about each of said cores, supplying a variable control current to each of said control windings in response to said corresponding error signal to vary the permeability of the corresponding core so that an increase in the control current being supplied to either of the control windings reduces the available permeability of that core and the flux linkage with magnetic fluxes generated by the corresponding inductor resulting in a redistribution of that inductor away from its corresponding core and a decrease in the control current to either of said control windings increases the available permeability of the corresponding core and the flux linkage with magnetic fluxes generated by the corresponding inductor resulting in a redistribution of the current in that inductor closer to its corresponding core whereby variations in the corresponding gap are minimized.

* * * * *